US009356340B2

(12) United States Patent
Nilsson

(10) Patent No.: US 9,356,340 B2
(45) **Date of Patent: *May 31, 2016**

(54) HIGH GAIN WIDEBAND OMNIDIRECTIONAL ANTENNA

(71) Applicant: Consolidated Radio, Inc., North Canton, OH (US)

(72) Inventor: Jack Nilsson, Canton, OH (US)

(73) Assignee: Consolidated Radio, Inc., North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/734,397

(22) Filed: Jun. 9, 2015

(65) Prior Publication Data

US 2015/0270605 A1 Sep. 24, 2015

Related U.S. Application Data

(63) Continuation-in-part of application No. 14/163,318, filed on Jan. 24, 2014.

(60) Provisional application No. 61/817,589, filed on Apr. 30, 2013, provisional application No. 61/756,137, filed on Jan. 24, 2013.

(51) Int. Cl.

| | |
|---|---|
| ***H01Q 13/04*** | (2006.01) |
| ***H01Q 1/36*** | (2006.01) |
| ***H01Q 1/42*** | (2006.01) |
| ***H01Q 9/28*** | (2006.01) |
| ***H01Q 21/08*** | (2006.01) |

(52) U.S. Cl.

CPC . *H01Q 1/36* (2013.01); *H01Q 1/42* (2013.01); *H01Q 9/28* (2013.01); *H01Q 21/08* (2013.01)

(58) Field of Classification Search

CPC ..... H01Q 13/04; H01Q 21/08; H01Q 1/42; H01Q 13/0258; H01Q 1/08

USPC ..... 343/774, 773, 808, 846

See application file for complete search history.

(56) References Cited

U.S. PATENT DOCUMENTS

| | | | | |
|---|---|---|---|---|
| 5,534,880 | A | 7/1996 | Button et al. | |
| 6,057,804 | A | 5/2000 | Kaegebein | |
| 6,154,182 | A * | 11/2000 | McLean | H01Q 9/28 343/752 |
| 6,191,751 | B1 * | 2/2001 | Johnson | H01Q 1/3291 343/713 |
| 6,593,892 | B2 | 7/2003 | Honda et al. | |
| 6,947,006 | B2 | 9/2005 | Diximus et al. | |
| 7,215,292 | B2 * | 5/2007 | McLean | H01Q 7/00 343/725 |
| 7,855,693 | B2 | 12/2010 | Martek et al. | |
| 8,228,257 | B2 | 7/2012 | Lalezari | |
| 8,730,118 | B1 * | 5/2014 | McLean | H01Q 9/28 343/773 |
| 2005/0219136 | A1 * | 10/2005 | Iskander | H01Q 13/08 343/772 |

* cited by examiner

*Primary Examiner* — Huedung Mancuso

(74) *Attorney, Agent, or Firm* — Sand & Sebolt; Howard L. Wernow

(57) ABSTRACT

The present invention relates to a series fed collinear antenna which includes cone-shaped radiating elements energized via a series fed common transmission line. Phasing stubs are provided between selected radiating elements and are oriented such that the phasing stub improves gain and reliability by affecting the signal to produce a beneficial elevational coordinate signal pattern. The radiating elements may be cones. Each cone has an associated base diameter. The base diameter may be uniform, resulting in similarly sized cones, or a cone may have a distinct base diameter resulting in differently sized cone elements.

20 Claims, 11 Drawing Sheets

HIGH GAIN WIDEBAND OMNIDIRECTIONAL ANTENNA

CROSS-REFERENCE TO RELATED APPLICATION

This application is a continuation-in-part of U.S. application Ser. No. 14/163,318, filed Jan. 24, 2014, which claims the benefit of U.S. Provisional Application Ser. No. 61/817,589, filed Apr. 30, 2013 and U.S. Provisional Application Ser. No. 61/756,137, filed Jan. 24, 2013; the disclosures of which are incorporated herein by reference.

BACKGROUND OF THE INVENTION

1. Technical Field

This invention relates to a device for transmitting and receiving electromagnetic waves. More particularly, this invention relates to a high gain omnidirectional antenna. Specifically, this invention relates to a series fed omnidirectional antenna formed via collinear cone elements which are phased using external elements angled with respect to the overall longitudinal axis of the antenna. Further, this invention relates to incorporating a dome shaped ground plane element into the overall series fed omnidirectional antenna design.

2. Background Information

The standard series-fed collinear high gain omnidirectional antenna design has several undesirable characteristics such as a distinctly narrowed frequency range. This narrowed frequency range applies to gain, standing wave radio (SWR), and overall pattern. The primary elevation coordinate signal pattern drops well below the horizon with frequency decreasing below the optimal tuned frequency. Conversely, corporate-fed coaxial dipoles seen for decades mounted on towers and masts, maintain the elevation coordinate signal pattern near the horizon at all tuned frequencies. While the series-fed collinear designs occupy a small horizontal space, typically contained in a vertical tube made of fiberglass, corporate fed coaxial dipoles around a mast or tower take up an enormous amount of horizontal space. This leads to problems with wind shear and elements as a fiberglass tube generally is not available for protection from the elements for such a large horizontal structure.

More recent designs have attempted to combine the smaller lateral dimension advantage of standard series-fed collinear antennas with the broader frequency range maintained near horizon of the standard horizontally spaced corporate-fed omnidirectional antennas. Inasmuch as there are increasing needs for broader frequency band antennas, there is a tremendous need in the art for antennas which have reliably broader frequency ranges.

As seen in U.S. Pat. No. 6,057,804, and in particular, FIGS. 11 and 12, one significant design issue with corporate-fed coaxial dipoles relates to incorporating the complex feed system into the overall antenna design. The disclosure of U.S. Pat. No. 6,057,804 incorporates cylindrical element dipoles of substantially larger diameter such that the corporate-fed system has room inside the center of these stacked cylindrical dipoles for encapsulating the feed system. One will readily recognize this design is inherently very complex and involves an exponentially increasing number of connections as the input signal is split for each cylindrical dipole added.

There have been attempts to recognize the broad frequency band characteristics of the cone-style element and incorporate such cone-style into a corporate fed design. As shown in U.S. Pat. No. 7,855,693, and in particular, FIGS. 1 and 2, this design does not alleviate the complexity of powering each coned element. This can be further shown in U.S. Pat. No. 5,534,880, and in particular FIG. 2.

SUMMARY

The present invention includes a novel approach to expanding the gain and reliability of a series fed collinear antenna. The present invention includes cone-shaped radiating elements energized via a series fed common transmission line. Phasing stubs are provided between selected radiating elements and are oriented such that the phasing stub improves gain and reliability by affecting the signal to produce a beneficial elevational coordinate signal pattern. A ground plane may be provided proximate the cone-shaped radiating elements to further enhance the radiated signal. This ground plane may be formed in a dome shape with the apex of the dome generally vertically spaced above the outer rim of the dome. This ground plane may have a surface length from the apex of the dome to the rim greater than ¼ wave, with the surface length preferably around ½ wave length or greater.

In one aspect, the invention may provide a series-fed collinear high gain omnidirectional antenna adapted to radiate electromagnetic energy at an intended frequency having a wave length, the antenna comprising: a first radiative element comprised of a first cone having a first apex and a second cone having a second apex, wherein the first apex is secured to the second apex; a second radiative element comprised of a third cone having a third apex; and a first phasing stub extending outwardly away from the second cone to a first phasing stub apex and extending inwardly from the first phasing stub apex the third cone, wherein the first phasing stub includes a first length configured synchronize radiative phase between the first radiative element and the second radiative element.

In another aspect, the invention may provide a series fed collinear antenna comprising: a first cone shaped element having a first apex and a first base and adapted to radiate electromagnetic energy; a second cone shaped element having a second apex and a second base and adapted to radiate electromagnetic energy; a phasing stub having a length and extending outwardly away from the first cone shaped element and the second cone shaped element; wherein the phasing stub electrically connects the first cone shaped element and the second cone shaped element; and wherein the length is configured synchronize radiative phase between the first cone shaped element and the second cone shaped element.

In another aspect, the invention may provide an antenna comprising: a first element having a first end and a spaced apart second end and adapted to radiate electromagnetic energy; a second element having a third end and a spaced apart fourth end and adapted to radiate electromagnetic energy; at least one phasing stub having a length and extending outwardly away from the first element to a phasing stub apex and extending inwardly to the second element from the phasing stub apex; a transmitter for supplying electrical power to one of the first element and the second element; wherein the at least one phasing stub electrically connects the first element and the second element in series; and wherein the length is configured to synchronize radiative phase between the first element and the second element.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings

DETAILED DESCRIPTION

Figure 1:
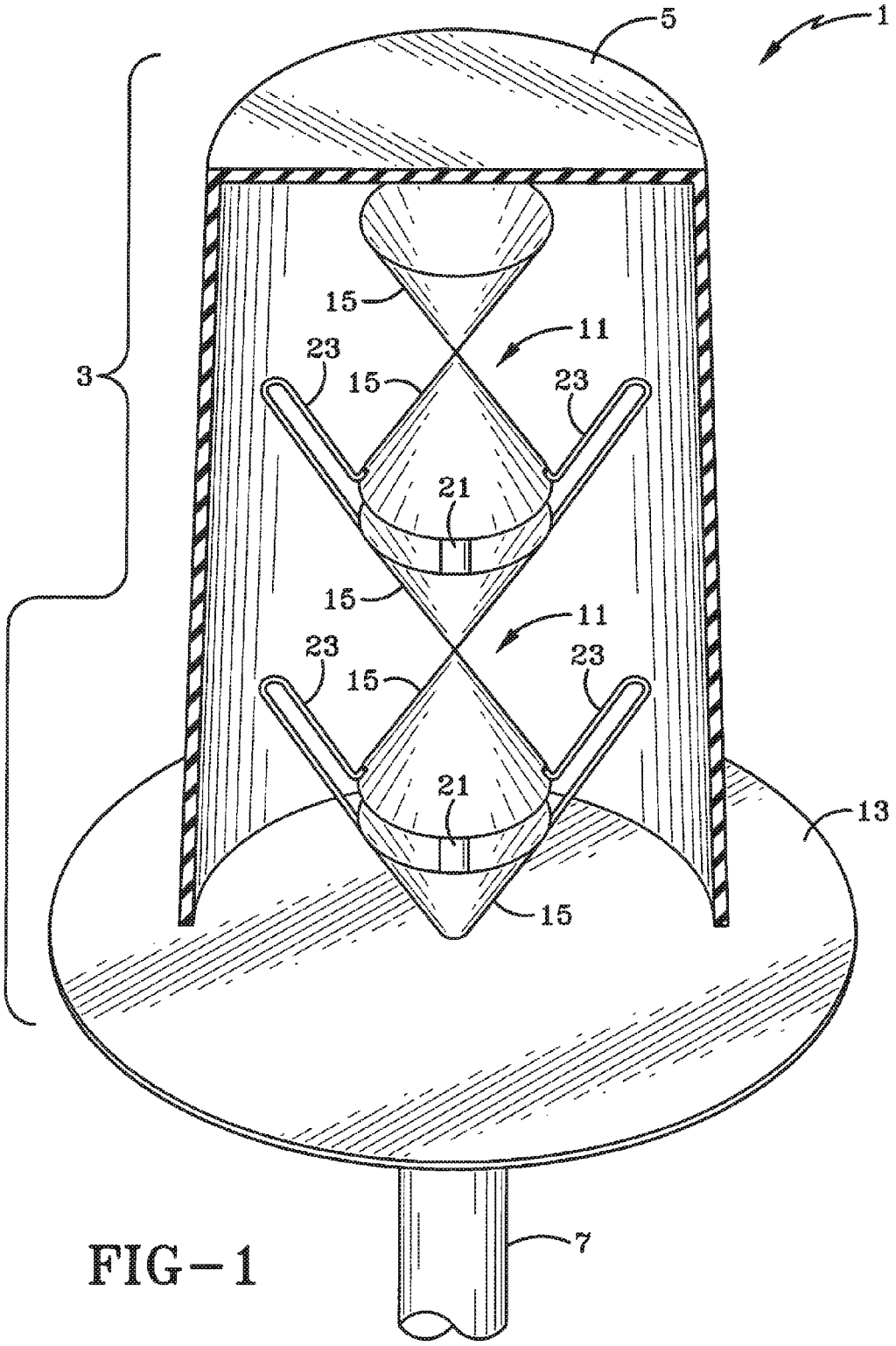
FIG. 1 is a perspective cross-sectional view of the antenna of the present invention.
Figure 2:
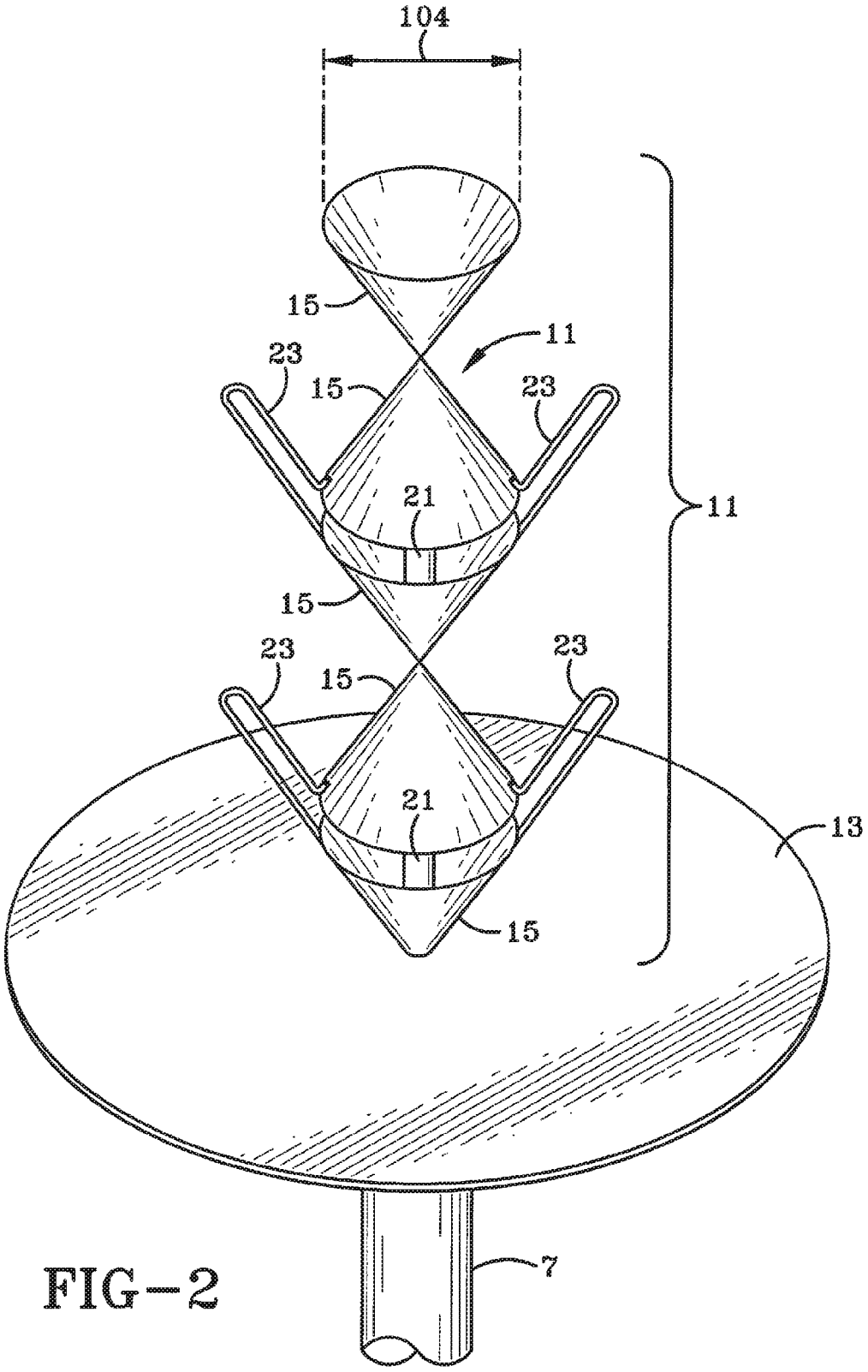
FIG. 2 is a perspective view of the antenna of the present invention.

The high gain wideband omnidirectional antenna of the present invention is shown in FIGS. 1-8 and is indicated generally at 1. As shown in FIG. 1, antenna 1 is typically formed as part of an overall antenna module 3 having antenna 1 encapsulated within a radome protective covering 5 to offer protection from weather elements. Antenna 1 is further typically connected to a mast 7 which may be hollow or solidified, depending on the desired configuration. As shown in FIG. 2, mast 7 may provide a structure for bringing a power cable 9 to antenna 1 to transmit power for energizing antenna 1. In the preferred embodiment, power cable 9 is a coaxial type of cable having a first power line 10 also referred to as the center lead and a second power line 12 also referred to as the shield, as shown in FIG. 3*a*. However, as commonly known in the art, power cable 9 may be of any type of power delivery cable, including twin lead with balun. Further, the present invention may include other structures as well or methods commonly known in the art for energizing antenna 1.

Figure 3A:
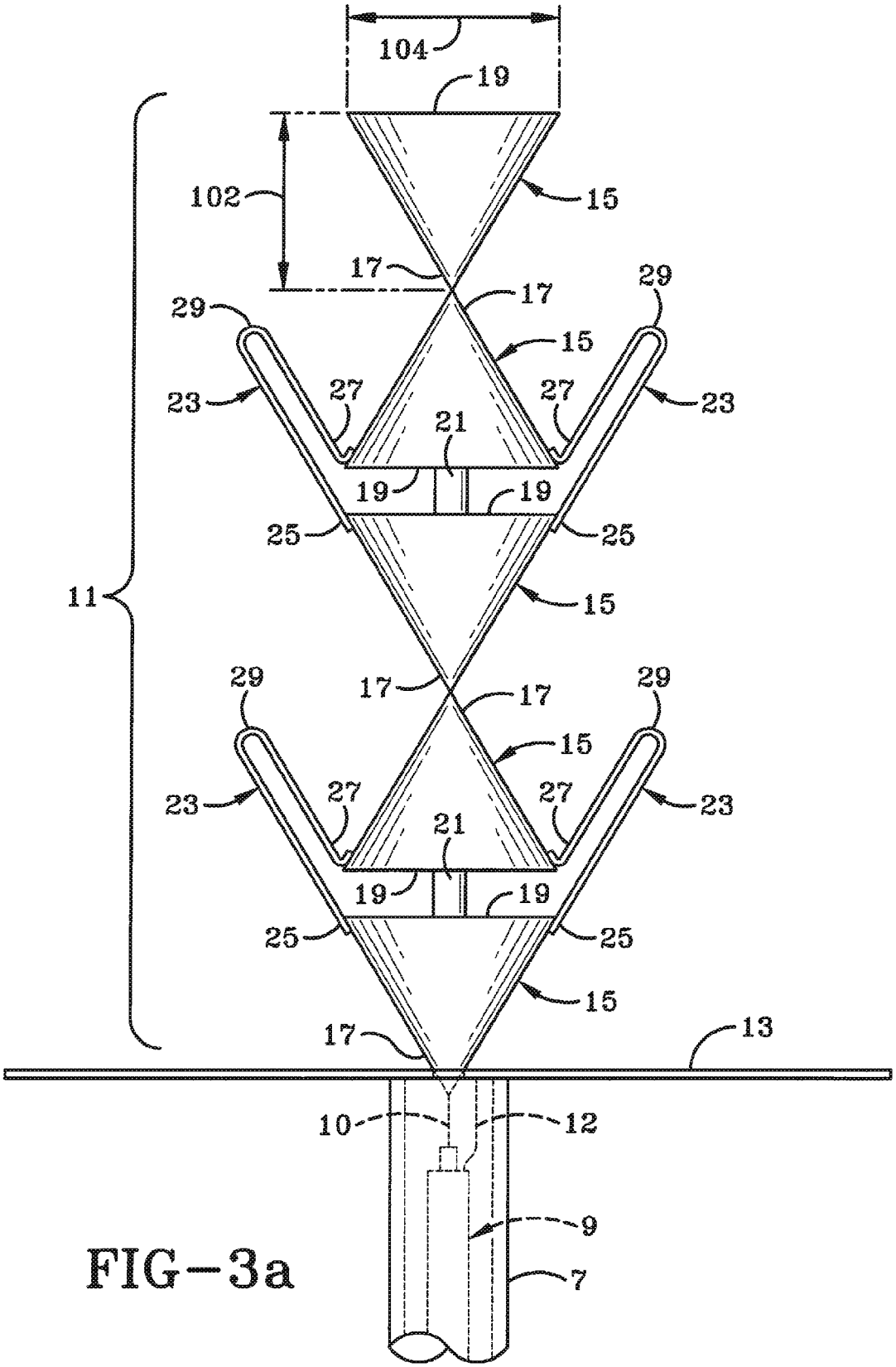
FIG. 3*a* is an elevational view thereof.

As shown in FIGS. 2 and 3*a*, antenna 1 is comprised primarily of a multi-coned section 11 energized by first power line 10 and a ground plane 13 energized by second power line 12. Coned section 11 is comprised of five cone elements, whereby each cone element 15 is formed in a conical shape and has a side length of approximately ¼ of the wavelength intended to be sent/received by antenna 1. Cone elements 15 are stacked consecutively, transposing the vertical position of an apex 17 of the particular cone element 15, with adjacent apexes 17 conductively connected to one another. Conversely, each cone element 15 further includes a base 19, which is separated from the next base 19 in the series by way of a non-conductive stabilizing beam 21. Stabilizing beams 21 separate one base 19 from the next base 19 and act to stabilize the overall coned section 11.

In the preferred embodiment, cone elements 15 are made from any conductive material, for example copper, and sized to have an overall side length of generally ¼ of the wave intended to be sent and/or received via antenna 1. As shown in FIG. 3*a*, the apex 17 of each cone element 15 is connected or secured to the apex 17 of an adjacent cone element 15. As such, this two cone element 15 structure is sized to have an operational resonant length of about ½ wave. As discussed previously, base 19 of each cone element 15 is not directly abuttably connected to the adjacent cone element 15. Base 19 of each cone element 15 is spaced apart from the adjacent cone element 15. However, inasmuch as the overall coned section 11 is energized in a series fed configuration, adjacent bases 19 are electrically connected via at least one phasing stub 23.

Figure 3B:
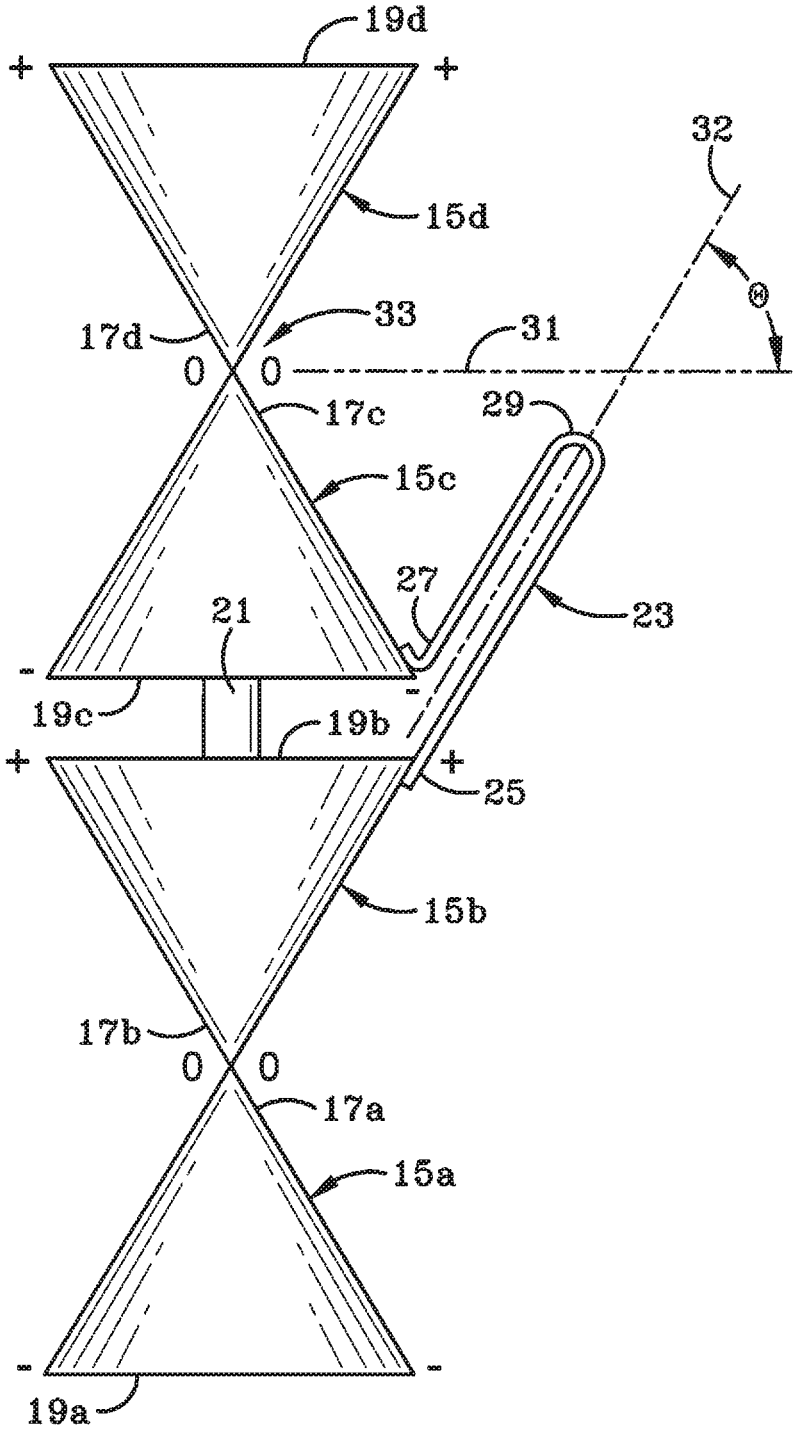
FIG. 3*b* is an elevational view of a section of the antenna of the present invention, showing two of the radiating elements.

As shown in FIGS. 3*a* and 3*b*, at least one phasing stub 23 extends from the base 19 of a cone element 15 to the adjacent base 19 of an adjacent cone element 15. This arrangement can be seen more particularly in FIG. 3*b*, where cone element 15*b* and adjacent cone element 15*c* are jointly supported with stabilizing beam 21 extending therebetween. Phasing stub 23 includes a first end 25 proximate base 19*b* of cone element 15*b* which extends to a second end 27 proximate base 19*c* of cone element 15*c*. As shown in FIG. 3*b*, with respect to the overall shape, phasing stub 23 extends from base 19*b* and first end 25 in an upwardly and outwardly extending direction to a phasing stub apex 29 and thereafter extends in a downwardly and inwardly extending direction to base 19*c* and second end 27. As shown in FIG. 3*b*, phasing stub 23 may extend such that phasing stub apex 29 is approximately co-planer with apex 17*c* of cone element 15*c* or at least generally proximate an imaginary horizontal plane 31.

Phasing stub 23 includes two important features. The first important feature relates to the overall length of phasing stub 23, and more particularly the distance between first end 25 and second end 27 with respect to the adjacent cone elements 15 in the series. Phasing stub 23 is configured such that the operating length is approximately one-half wavelength (A). The length of phasing stub 23 ensures that the overall longitudinal wave cycle from the power cable 9 feed to the outer end of antenna 1 is similar for each two cone element 15 block. The length of phasing stub 23 therefore is configured to synchronize radiative phase between the cones it connects. Inasmuch as each two cone element 15 structure is sized to have an operational resonant length of about ½ wave and each phasing stub 23 connecting adjacent two cone element 15 structures is ½ wave, phasing stub 23 synchronizes the electromagnetic waves radiating from each two cone element 15 structure. For example, as shown in FIG. 3*b* at a given moment $M_x$ the two cone element 15 comprised of cone element 15*a* connected to cone element 15*b* transitions from a negative wave amplitude at base 19*a*, to a neutral or zero wave amplitude at apexes 17*a* and 17*b*, and thereafter to a positive wave amplitude proximate base 19*b*. Inasmuch as base 19*b* and 19*c* are conductively separated by stabilizing beam 21 and the overall coned section 11 is a series fed antenna design, cone element 15*b* and cone element 15*c* must necessarily be conductively connected to continue the series. This is accomplished via phasing stub 23. To maintain longitudinal consistency with respect to wave amplitude, phasing stub 23 is provided with an operational length equal to one half wavelength (λ). As seen in FIG. 3*b*, a half wavelength phasing stub 23 allows the wave to conductively connect to the adjacent cone at the appropriate phase to maintain longitudinal consistency throughout coned section 11. In other terms, at a given moment $M_x$, whatever portion of the waveform base 19*a* is experiencing, phasing stub 23 ensures base 19*c* is experiencing the same portion of the waveform at the previous cycle of the wave. For example, at moment $M_x$, if the fraction of the wave cycle at base 19*a* of cone element 15*a* is a negative amplitude, the fraction of the wave cycle at base 19*c* of cone element 15*c* is also a similar negative amplitude.

The second important feature provided by phasing stub 23 is gain enhancement, particularly when compared to other phasing stub solutions which provide a parasitic effect and can diminish the overall gain of the antenna. Previous attempts at placing phasing stubs outside of the radiative elements of the antenna were failures due to the parasitic effect of the phasing stub on the electronic field radiated by the antenna. To that end, prior art phasing solutions were directed to making phasing elements more invisible with respect to the electronic field, by placing the phasing elements inside the radiating elements, as opposed to extending outwardly from the overall longitudinal axis of the antenna. These solutions were used to minimize the gain diminishing effects of the phasing elements. Conversely, rather than trying to minimize the parasitic effects of a phasing element, the present invention makes use of the phasing element to enhance the gain.

Phasing stub 23 is designed and positioned to generally continue the angle of the radiating cone element 15 immediately vertically below the particular phasing stub 23. As shown in FIG. 3*b*, one will readily recognize the angle of cone element 15*b* is continued by phasing stub 23 up to phasing stub apex 29, generally along an imaginary axis 32 of phasing stub 23 whereby imaginary axis 32 separates phasing stub 23 into two generally identical halves. Phasing stub 23 is preferably angled with respect to plane 31 such that there is approximately a 45° to 70° angle Θ between plane 31 and axis 32 of phasing stub 23, with the ideal angle being generally where Θ is equal to 60°. Positioning a radiating element near another radiating element may result in significant disruption to the gain and overall radiation pattern. However, it has been discovered that by orienting phasing stub 23 at approximately a 60° angle and aligning phasing stub 23 generally to continue the surface of cone element 15*b* towards phasing stub apex 29, the gain of antenna 1 is not diminished nor is the pattern disrupted. Conversely, the gain is enhanced due to phasing stub 23 and the open nature of this radiating element with respect to cone element 15*b*. A phasing stub with axis 32 parallel to plane 31 acts to "box" the signal in between the phasing stub and the lower cone element with the phasing stub as an upper bound on the signal. Conversely, the orientation of phasing stub 23 of the present invention acts to enhance the interaction between base upward cones, with base downward cones and ground plane 13. This represents an enormous leap in the art, as phasing solutions of previous embodiments necessarily affected the radiation pattern in a gain diminishing way.

Figure 3C:
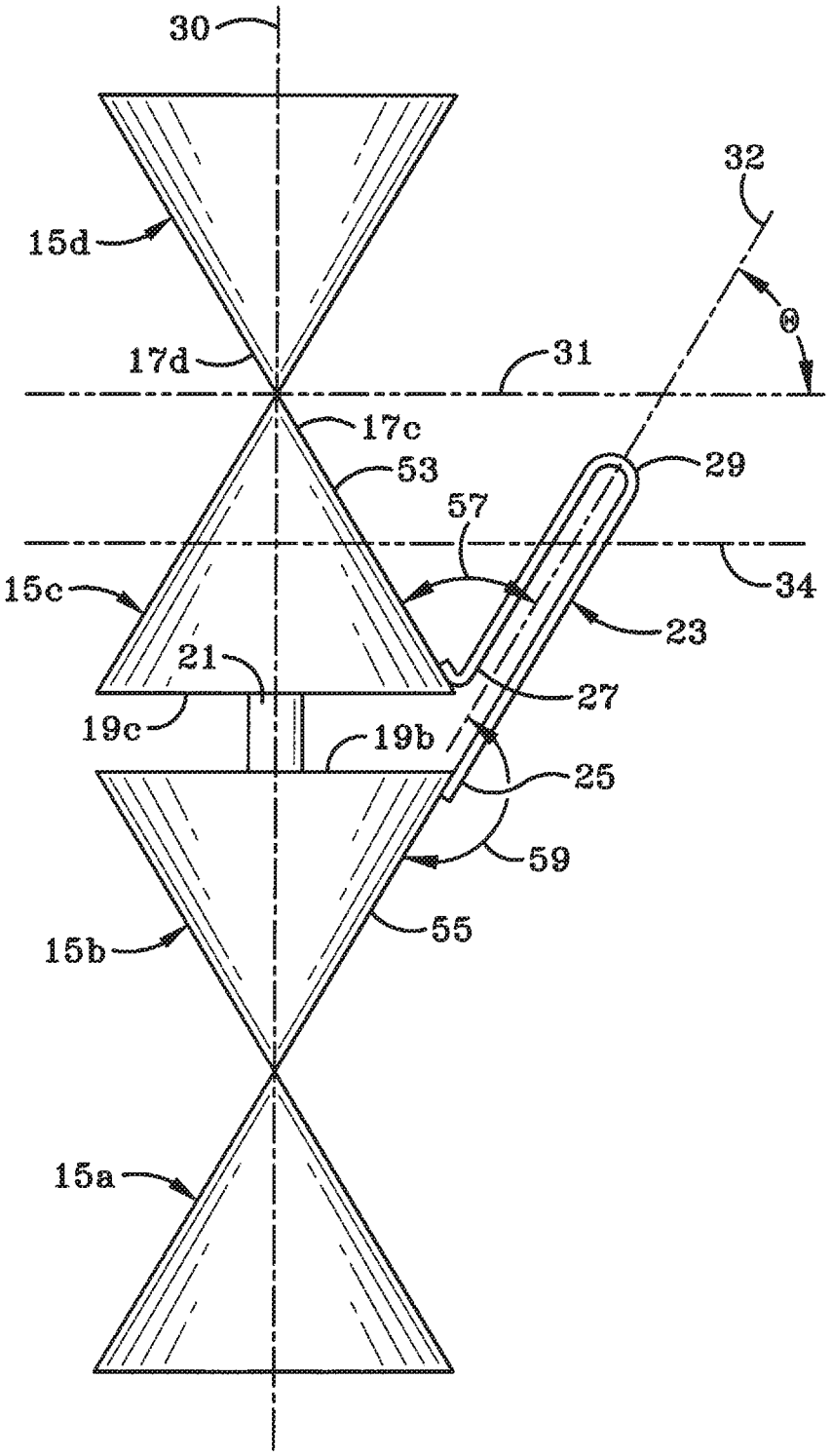
FIG. 3*c* is an elevational view of a second of the antenna of the present invention, showing two of the radiating elements.

As shown in FIG. 3*c*, there exists an imaginary longitudinal center axis 30 extending through the axial center of antenna 1. Further, there exists an imaginary middle plane 34 which extends horizontally through the longitudinal middle of cone element 15*c*. The longitudinal middle is defined as the general midpoint between apex 17*c* and base 19*c*. It is one of the primary features of the present invention that phasing stub apex 29 is disposed vertically above imaginary middle plane 34, as shown in FIG. 3*c*. Further, phasing stub apex 29 is disposed vertically below imaginary plane 31, which extends through apex 17*c* of cone element 15*c*. Cone element 15*c* includes an outer surface 53 and cone element 15*b* includes an outer surface 55. To further describe the preferred orientation of phasing stub 23, outer surface 53 in the area most proximate phasing stub 23 extends at an acute angle with respect to axis 32. Further, outer surface 55 in the area most proximate phasing stub 23 extends at an obtuse angle with respect to axis 32. As shown in FIG. 3*c*, one will recognize that phasing stub apex 29 is disposed between a midpoint of phasing stub 23 and second end 27 of phasing stub 23 and is not symmetrically disposed at the midpoint between first end 25 and second end 27 due to the angled and non-symmetrical nature of phasing stub 23.

Antenna 1 preferably includes three ½ wave radiating components, with the lower of those three components incorporating ground plane 13 in place of an apex-upward cone. For some background, typical ground planes used in the art may be oriented perpendicular to the axis of the antenna element and disposed generally horizontally parallel with the horizon. Other standard ground planes may angle downwardly such as a straight 30°, 45°, or 60° angle down with respect to the horizon. Further, standard ground planes generally are constructed with a radius of ¼ wave length. Ground plane 13 operates generally in the manner expected by those familiar with the art and is oriented generally horizontally parallel with the horizon. However, in addition to the expected and commonly known benefits of ground plane 13, it has been discovered that by making ground plane 13 comparatively substantial more continuous and of greater dimension there is increase in the overall bandwidth and gain of antenna 1.

Figure 7:
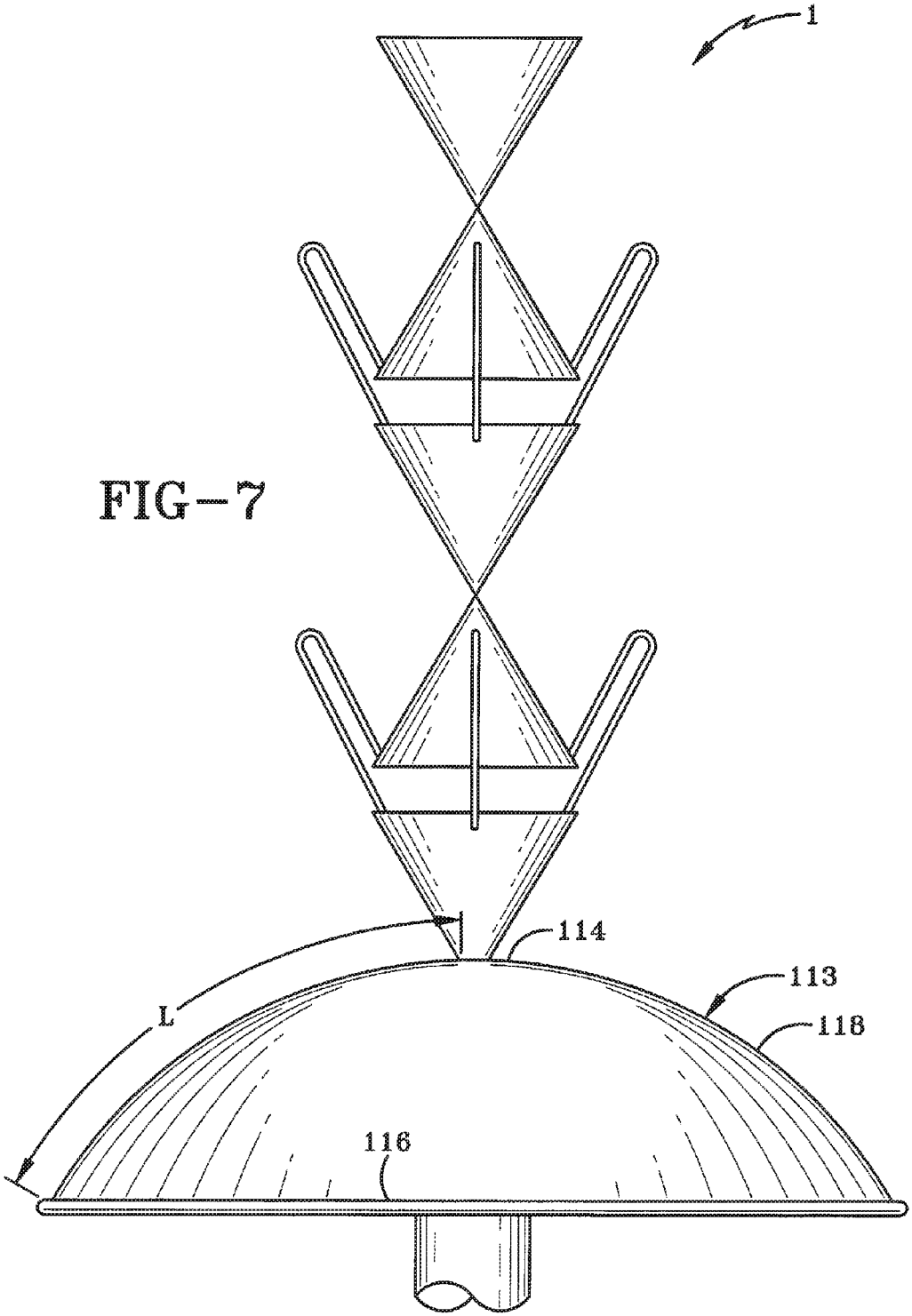
FIG. 7 is an elevational view of an antenna of the present invention incorporating a dome shaped ground plane.
Figure 8:
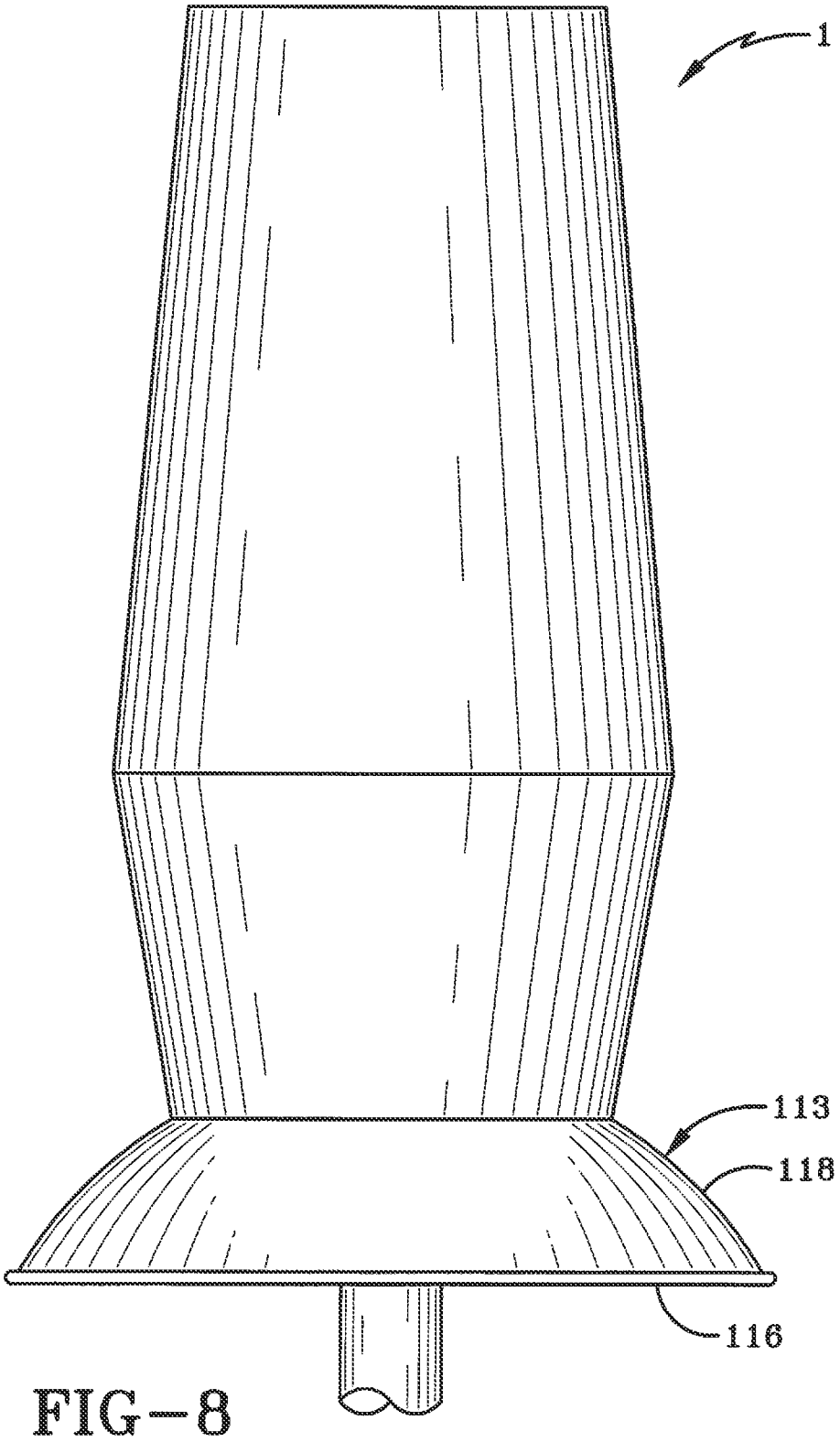
FIG. 8 is an elevational view of an antenna of the present invention similar to FIG. 6 and having a radome cover disposed thereon.

As shown in FIGS. 7 and 8, a ground plane 113 may be provided on antenna 1. Ground plane 113 is formed in a dome shape that generally resembles the hollow upper third of a sphere, having an apex 114 disposed vertically above a continuous rim 116. Ground plane 113 includes an arcuate outer surface 118 which is generally flat and smooth, although multiple curvilinear wires could be utilized, and formed in a curved or arcuate shape extending from apex 114 to rim 116. While typical ground planes are constructed with a center-to-edge length of ¼ wave length, it has been discovered that by forming ground plane 113 with an arcuate apex-to-rim length L generally equal to ½ wave length or greater, several beneficial effects are realized. These include a greater frequency bandwidth, particularly with respect to standing wave ratio and performance. The benefits further include an improved signal pattern and overall gain, as the dome shape of ground plane 113 couples and resonate with cone elements 15 and potentially with portions of phasing stubs 23, as described above. In summary, through extensive experimentation, it has been discovered that by forming ground plane 113 in a general dome shape and setting the arcuate apex-to-rim length of L generally equal to ½ wave length, enormous benefits have been achieved over a standard ground plane.

Figure 4:
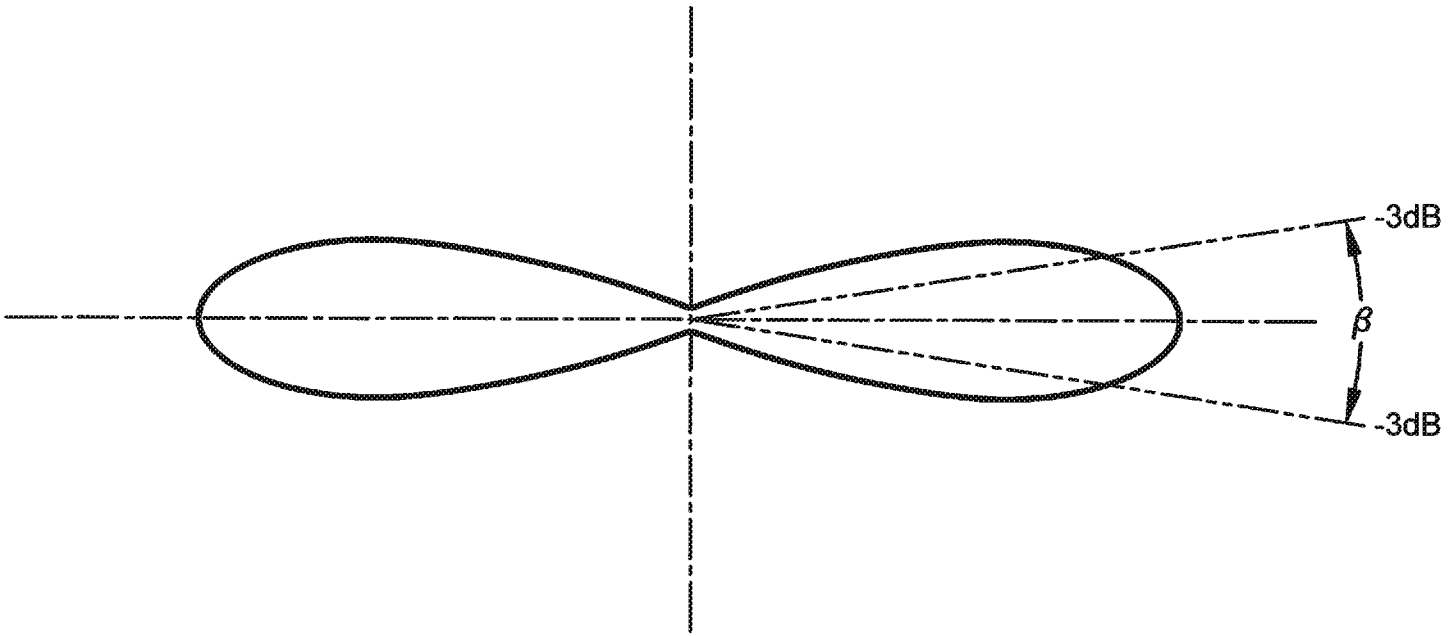
FIG. 4 is a representational elevational coordinate signal pattern radiated by the present invention.

FIG. 4 shows a sample elevation coordinate signal pattern for antenna 1. The signal pattern provided by antenna 1 portrays the merging of signal patterns provided by antenna 1 by way of reducing undesirable lobes while producing a broad and strong elevation signal pattern at, above, and below the horizon. The signal pattern also reduces signal overshoot problems seen with other designs where a radiated signal may pass over the desired target receiving unit. As shown in FIG. 4, antenna 1 resonates a high gain wideband omnidirectional signal which may be in the range of 3 dB above and below the horizontal and resonated at an angle generally of β.

Figure 5:
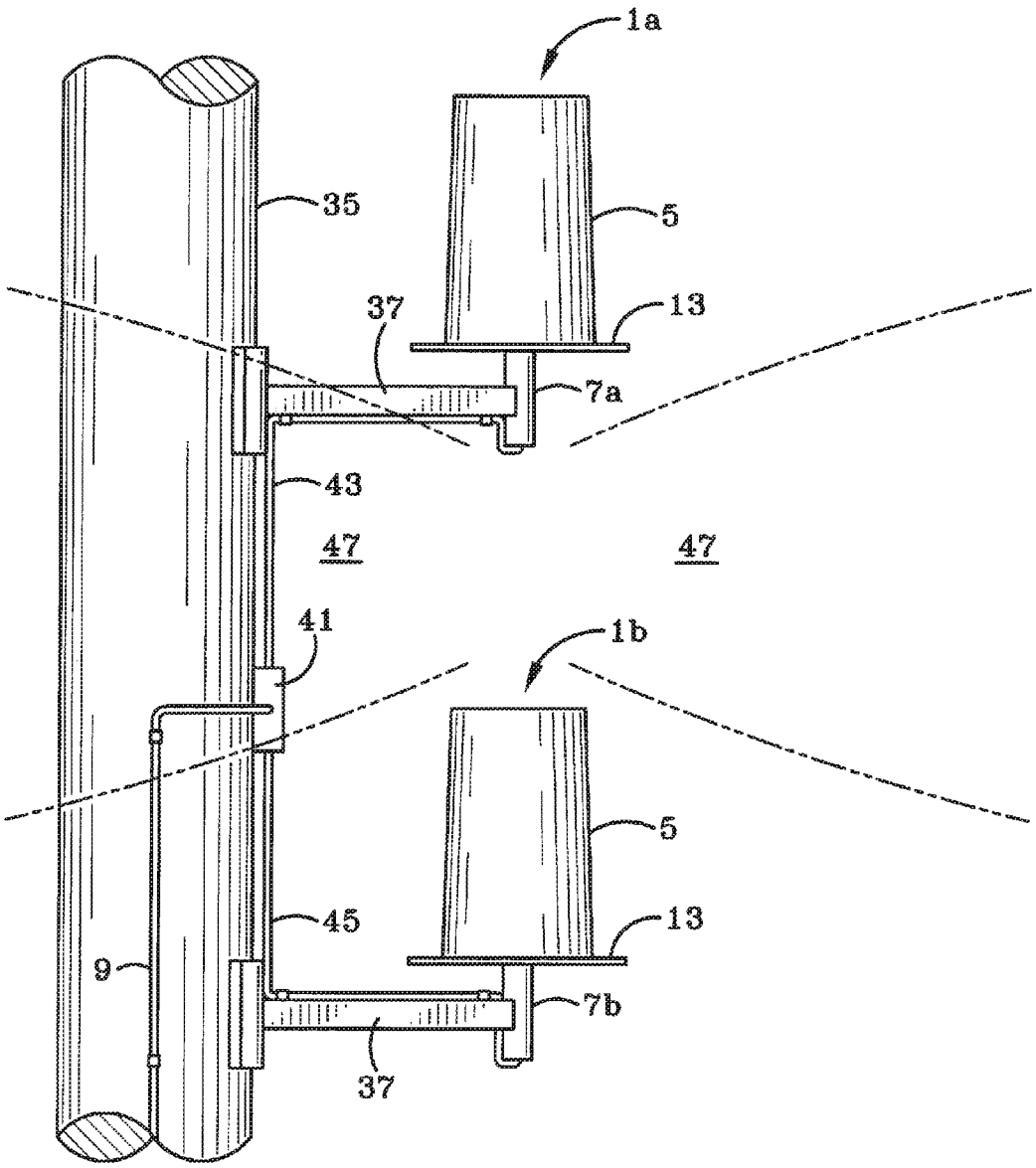
FIG. 5 is an elevational view of a pair of antennas of the present invention extending from a mast.

As shown in FIG. 5, the series-fed collinear high gain omnidirectional antenna 1 of the present invention may be stacked with multiple antennas 1 to increase the gain. As shown in FIG. 5, antenna 1*a* is stacked vertically coaxially with antenna 1*b*. Antenna 1*b* includes mast 7*a* connected to a first horizontal arm extending from a tower 35. Similarly, antenna 1*b* includes a mast 7*b* connected to a second vertical arm 39 extending from tower 35. First horizontal arm and second horizontal arm are generally similar in length in order to position antenna 1*a* directly vertically above antenna 1*b* in a generally coaxial alignment. As shown in FIG. 5, power line 9 extends along tower 35 and into a power divider 41 whereby power cable 9 is divided and split into equal lengths first power line 43 and second power line 45. First power line 43 energizes and provides power to antenna 1*a* while second power line 45 energizes and provides power to antenna 7*b*. The configuration represented in FIG. 5 is exemplary and may further include additional antennas 1 disposed about tower 35. A signal pattern 47 produced by antenna 1 in FIG. 5 is shown in phantom and is representational of the signal pattern produced by the present invention in the configuration of FIG. 5.

Figure 6:
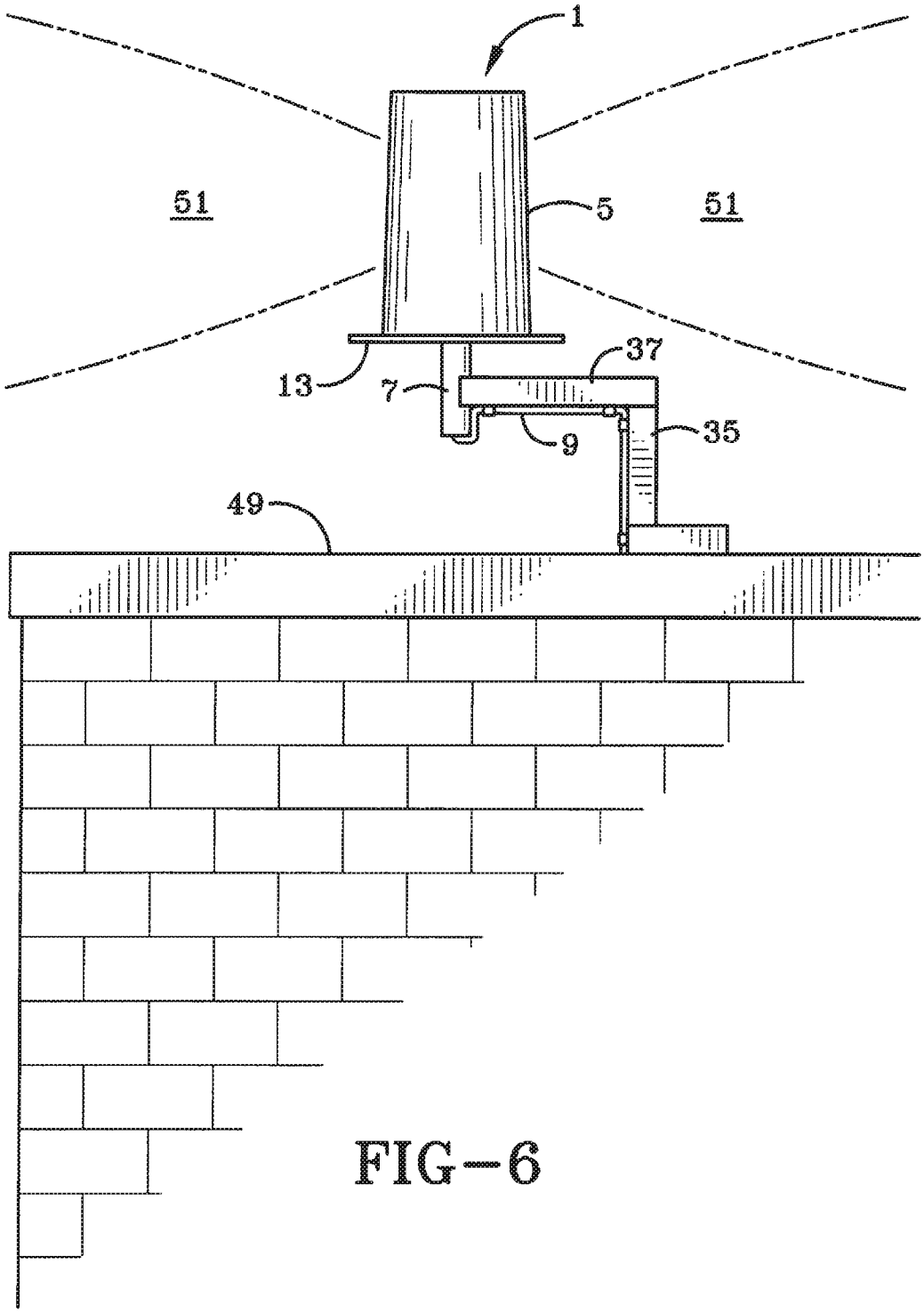
FIG. 6 is an elevational view of an antenna of the present invention extending from a building.

As shown in FIG. 6, antenna 1 may be used singularly as desired and as appropriate for particular applications, for example on a building 49. The embodiment shown in FIG. 6 includes antenna 1 connected to mast 7 which is in turn connected to first horizontal arm 37. First horizontal arm 37 extends outwardly from tower/mast 35 which is much smaller and more compact to take advantage of the overall height of building 49. Power cable 9 extends from building 49 up tower 35 and into antenna 1 as described in previous embodiments. A signal pattern 51 produced by antenna 1 in FIG. 6 is shown in phantom and is representational of the signal pattern produced by the present invention in the configuration of FIG. 6. Signal pattern 51 is broader and less far-reaching than signal pattern 47.

In other embodiments ground plane 13 may be for example the sheet metal of a roof of a building or of a vehicle, and may be even larger with similar benefits.

As depicted throughout FIG. 1 through FIG. 8, energized cone elements 15 on antenna 1 include are right circular cones including a longitudinal height 102 measured from the apex 17 through the center of base 19. Base 19 includes a diameter 104 measured from edge to edge through the center of base 19. Each cone element 15 in this embodiment is uniform in dimension relative to the other cone elements (i.e., all cone elements 15 are the same size). The height 102 is about four inches and the diameter 104 is about four inches. These dimensions optimize a frequency range in which antenna 1 receives signals. Energized cone elements 15 having the height 102 of four inches and a diameter 104 of four inches receive signals in an operative frequency range from about 600 MHz to about 1000 MHz. More particularly, cone elements receive signals in a frequency range from about 650 MHz to about 900 MHz. Even more specifically, cone elements 15 receive signals in a frequency range from 690 MHz to 870 MHz.

Figure 9:
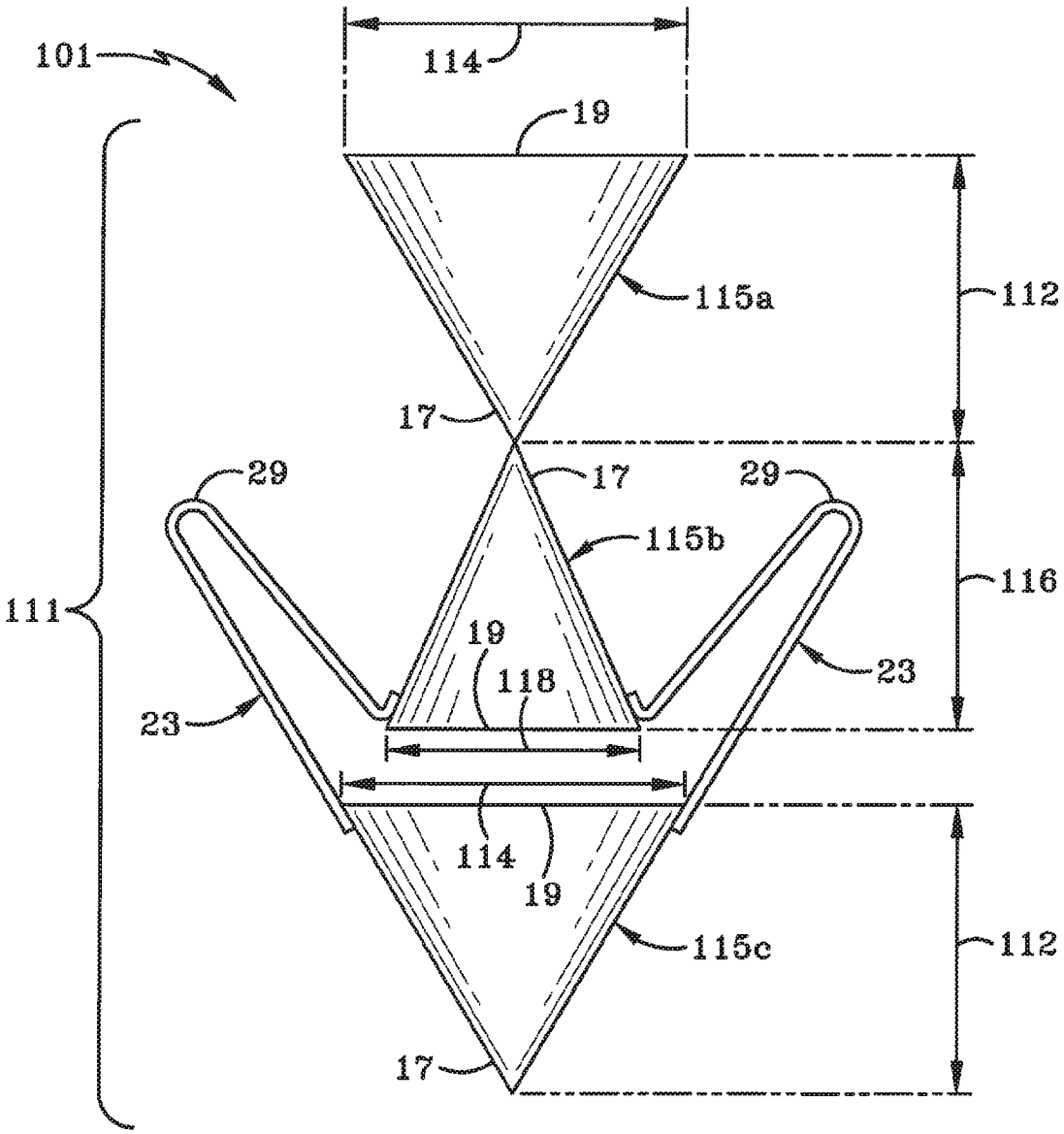
FIG. 9 is an elevational view of a second embodiment of the present invention depicting cone elements of different dimensions.

An alternative embodiment antenna of the present invention is depicted in FIG. 9 generally as 101. Antenna 101 includes similar outer housing elements as antenna 1 but provides a distinct energized cone section 111 including stacked cone elements 115*a*, 115*b*, and 115*c*. Cone element 115*a* (also referred to as first cone element 115*a*) is a right circular cone including a longitudinal height 112 measured from apex 17 through the center of base 19 and a base diameter 114 measured edge to edge through center of base 19. Longitudinal height 112 is about five inches and diameter 114 is about nine inches.

Cone element 115*b* is connected apex-to-apex with cone element 115*a*. However, unlike cone elements 15 in the first embodiment, cone element 115*b* (also referred to as second cone 115*b*) is a different size than first cone element 115*a*. Thus, energized cone section 111 comprises cone elements of different dimensions to receive signals at desired frequencies. Longitudinal height 116 of second cone element 115*b* is about five inches and diameter 118 of second cone element 115*b* is about six inches. It may be desirable to keep the heights of each respective cone element an equal size (e.g., here each cone has a longitudinal height of five inches). More particularly, antenna 101 comprises at least two energized cone elements 115*a*, 115*b*, wherein each respective cone has a base diameter different than the other cone.

In antenna 101, some cone elements may be similarly dimensioned as other cone elements, as long as one cone element is distinctly dimensioned from the rest. For example, the third cone element 115*c* is similarly dimensioned to first cone element 115*a* having a longitudinal height 112 equal to about five inches and a base diameter 114 equal to about nine inches. Alternatively, third cone element may be distinctly dimensioned from either first or second cone elements, resulting in three energized cone elements all of a different dimension or size. It is contemplated that even though the cone elements may be distinctly dimensioned, they are all right circular cones. Base 19 on third cone element 115*c* is spaced apart from base 19 on second cone element 115*b*. Phasing stub 23 is connected to base 19 on third cone element 115*c* and connected to base 19 on second cone element 115*b*. More particularly, phasing stub 23 extends outwardly away from base 19 on second cone 115*b* to a first phasing stub apex 29 and extends inwardly from the first phasing stub apex 29 to base 19 on the third cone 115*c*, wherein the phasing stub 23 includes a first length configured synchronize radiative phase between the second cone 115*b* and the third cone 115*c*.

The dimensional configuration of cone elements 115*a*, 115*b*, and 115*c* on antenna 101 allows for the reception of signals in an operative frequency range from about 300 MHz to about 600 MHz. More particularly, cone elements 115*a*, 115*b*, and 115*c* receive signals in a frequency range from about 350 MHz to about 550 MHz. Even more specifically, cone elements 115*a*, 115*b*, and 115*c* receive signals in a frequency range from 400 MHz to 500 MHz.

While the aforementioned cone elements in this application are right circular cones, other cone varieties are contemplated, such as oblique cones, circular or elliptical hyperboloids, or cones having a polygonal base.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed:

1. A series-fed collinear high gain omnidirectional antenna adapted to radiate electromagnetic energy at an intended frequency having a wave length, the antenna comprising:

an energized first cone having a first apex and a first diameter an energized second cone having a second apex and a second diameter, wherein the first apex is secured to the second apex and the second diameter is different than the first diameter;

an energized third cone having a third apex and a third diameter; and a first phasing stub extending outwardly away from the second cone to a first phasing stub apex and extending inwardly from the first phasing stub apex toward the third cone, wherein the first phasing stub includes a first length configured to synchronize radiative phase between the second energized cone and the third energized cone.

2. The series-fed collinear high gain omnidirectional antenna of claim 1, wherein the first diameter is larger than 4 inches.

3. The series-fed collinear high gain omnidirectional antenna of claim 2, wherein the first diameter is in a range from about 6 inches to about 12 inches.

4. The series-fed collinear high gain omnidirectional antenna of claim 3, wherein the first diameter is about 9 inches.

5. The series-fed collinear high gain omnidirectional antenna of claim 1, wherein the second diameter is larger than 4 inches.

6. The series-fed collinear high gain omnidirectional antenna of claim 5, wherein the second diameter is in a range from about 4 inches to about 6 inches.

7. The series-fed collinear high gain omnidirectional antenna of claim 3, wherein the second diameter is about 5 inches.

8. The series-fed collinear high gain omnidirectional antenna of claim 1, wherein the third diameter is equal to the first diameter.

9. The series-fed collinear high gain omnidirectional antenna of claim 1, wherein the third diameter is different than the first diameter.

10. The series-fed collinear high gain omnidirectional antenna of claim 9, wherein the third diameter is different than the second diameter.

11. The series-fed collinear high gain omnidirectional antenna of claim 1, further comprising:

an operative frequency range for receiving signals from about 300 MHz to about 600 MHz.

12. The series-fed collinear high gain omnidirectional antenna of claim 11, wherein the operative frequency range is from about 400 MHz to about 500 MHz.

13. The series-fed collinear high gain omnidirectional antenna of claim 1, further comprising:

a first cone length measured from the first apex to a first cone base;

a second cone length measured from the second apex to a second cone base, wherein the first and second cone length are equal.

14. The series-fed collinear high gain omnidirectional antenna of claim 13, wherein the first and second cone length is about five inches.

15. The series-fed collinear high gain omnidirectional antenna of claim 1, further comprising:

a third cone length measured from the third apex to a third cone base, wherein the third cone length is equal to the first and second cone length.

16. A series-fed collinear high gain omnidirectional antenna adapted to radiate electromagnetic energy at an intended frequency having a wave length, the antenna comprising:

an energized first cone having a first apex and a first diameter an energized second cone having a second apex and a second diameter, wherein the first apex is secured to the second apex;

an energized third cone having a third apex and a third diameter;

a first phasing stub extending outwardly away from the second cone to a first phasing stub apex and extending inwardly from the first phasing stub apex toward the third cone, wherein the first phasing stub includes a first length configured to synchronize radiative phase between the first radiative element and the second radiative element; and an operative frequency range for receiving signals from about 600 MHz to about 1000 MHz.

17. The series-fed collinear high gain omnidirectional antenna of claim 16, wherein the first and third diameters are equal.

18. The series-fed collinear high gain omnidirectional antenna of claim 16, wherein the first, second, and third diameters are equal.

19. The series-fed collinear high gain omnidirectional antenna of claim 18, wherein the operative frequency range is from 650 MHz to about 900 MHz.

20. The series-fed collinear high gain omnidirectional antenna of claim 19, wherein the operative frequency range is from 690 MHz to 870 MHz.

* * * * *